US006981294B2

(12) United States Patent
Edwards

(10) Patent No.: US 6,981,294 B2
(45) Date of Patent: Jan. 3, 2006

(54) CARPET SLIDE FOR RECREATIONAL USE

(75) Inventor: Donald V. Edwards, Harrison City, PA (US)

(73) Assignee: Simtec, Co., Irwin, PA (US)

( * ) Notice: Subject to any disclaimer, the term of this patent is extended or adjusted under 35 U.S.C. 154(b) by 19 days.

(21) Appl. No.: 10/669,815

(22) Filed: Sep. 24, 2003

(65) Prior Publication Data

US 2004/0068832 A1 Apr. 15, 2004

Related U.S. Application Data

(63) Continuation-in-part of application No. 10/233,366, filed on Sep. 3, 2002, now abandoned, which is a continuation-in-part of application No. 10/086,282, filed on Mar. 4, 2002, now abandoned.

(51) Int. Cl.
*A47B 91/00* (2006.01)
*A47B 91/06* (2006.01)

(52) U.S. Cl. ..... 16/42 R; 36/122; 280/600

(58) Field of Classification Search ..... 16/42 R, 16/42 T; 248/188.9; 36/122, 124; 280/28, 280/841, 600, 842, 845, 604, 607, 609, 11.3
See application file for complete search history.

(56) References Cited

U.S. PATENT DOCUMENTS 1,783,833 A * 12/1930 Elsner ..... 280/604
1,886,650 A * 11/1932 Davies et al. ..... 280/600
2,810,213 A * 10/1957 Jonas ..... 36/1
3,269,037 A * 8/1966 Massicotte ..... 36/124
3,416,626 A * 12/1968 Nagamatsu ..... 180/124
3,965,586 A * 6/1976 Roosli ..... 36/7.3
4,004,355 A * 1/1977 Koblick ..... 36/122
4,674,764 A * 6/1987 Miesen ..... 280/604
5,341,582 A * 8/1994 Liautaud ..... 36/7.6
5,398,957 A * 3/1995 Leighton et al. ..... 280/600
6,206,424 B1 * 3/2001 Edwards et al. ..... 280/845
6,367,173 B2 * 4/2002 Lancon ..... 36/122
6,401,367 B2 * 6/2002 Lancon ..... 36/124

* cited by examiner

*Primary Examiner*—Chuck Y. Mah
(74) *Attorney, Agent, or Firm*—James Ray & Assoc.

(57) ABSTRACT

A carpet slide for use as a recreational entertainment device includes a first member having a predetermined shape and a predetermined size. The first member is formed from a flexible sheet of material having an upper surface and a bottom surface. An at least one strap like member having a first end and a second end is provided. A first mechanism is disposed along the upper surface of such first member adjacent a first outer edge portion thereof between a front portion of the first member and a back portion of such first member for engaging a first end of the at least one strap like member. A second mechanism is disposed along the upper surface adjacent a radially opposed second outer edge portion thereof between the front portion of such first member and the back portion of such first member for engaging a second end of such at least one strap like member.

20 Claims, 6 Drawing Sheets

SECTION VIEW

CARPET SLIDE FOR RECREATIONAL USE

CROSS REFERENCE TO RELATED APPLICATIONS

This application is a Continuation-In-Part of U.S. patent application Ser. No. 10/233,366 filed Sep. 3, 2002 which is a Continuation-In-Part of U.S. patent application Ser. No. 10/086,282 filed Mar. 4, 2002, both applications now abandoned.

FIELD OF THE INVENTION

The present invention relates, in general, to recreational devices and, more particularly, this invention relates to a slide which is applied to the feet of the participant for sliding on carpet for recreational use.

BACKGROUND OF THE INVENTION

Prior to the conception and development of the present invention, as is generally well known in the prior art, there are various recreational devices available commercially which will enable a person to slide of certain type surfaces for recreational purposes.

As is also generally well known in the art, these devices all require either a hill, rollers/wheels, or at least a slippery surface, such as, snow in order to enable these prior art devices to work effectively.

Additionally, prior to the present invention, there were no devices known to applicant which are designed specifically for use indoors on carpeted surfaces.

OBJECTS OF THE PRESENT INVENTION

It is, therefore, one of the primary objects of the present invention to provide a recreational device for use indoors on carpeted floors which will enable the user to slide on such carpeted floor.

Another object of the present invention is to provide a recreational device for use on carpeted floors which is relatively inexpensive to manufacture.

Still another object of the present invention is to provide a recreational device for use on carpeted floors which is easy to use.

Yet another object of the present invention is to provide a recreational device for use on carpeted floors which will not damage the carpet during use.

A further object of the present invention is to provide a recreational device for use on carpeted floors which is relatively light weight.

Still yet another object of the present invention is to provide a recreational device for use on carpeted floors which can be designed to enable relatively easy turning in predetermined directions.

An additional object of the present invention is to provide a recreational device for use on carpeted floors which can fit a variety of different size feet.

Still a further object of the present invention is to provide a recreational device for use on carpeted floors which will exhibit a relatively long useful life.

In addition to the above described objects and advantages of the present invention, various additional objects and advantages of the recreational slides according to the instant invention will become more readily apparent to those persons skilled in the relevant art from the following more detailed description, particularly, when such description is taken in conjunction with the attached drawing Figures and with the appended claims.

SUMMARY OF THE INVENTION

The present invention provides, in a first aspect, a carpet slide for use as a recreational entertainment device. Such carpet slide includes a first member, having a predetermined shape and a predetermined size. The first member is formed from a flexible sheet of material having an upper surface and a bottom surface. There is at least one strap like member having a first end and a second end. A first means, having a first aperture formed therethrough, is disposed substantially lengthwise along the upper surface of such first member adjacent a first outer edge portion thereof between a front portion of the first member and a back portion of such first member for receiving a first end of the at least one strap like member through this first aperture. Finally, there is a second means, having a second aperture formed therethrough, disposed substantially lengthwise along such upper surface adjacent a substantially radially opposed second outer edge portion thereof between such front portion of the first member and the back portion of such first member for receiving a second end of the at least one strap like member through such second aperture.

In a second aspect, the present invention provides a recreational shoe for use in sliding on carpeted surfaces. The recreational shoe comprises a foot supporting sole portion having a predetermined shape and a predetermined size. The foot supporting sole portion is formed from a sheet of flexible material having an upper surface and a bottom surface. The bottom surface of such foot supporting sole portion has a coefficient of friction which is at least sufficiently low enough to enable easy sliding on such carpeted surface. A foot retaining upper portion is secured to such top surface of the foot supporting sole portion. The final essential element of the recreational shoe is a securing means disposed on such foot retaining upper portion for securing such recreational shoe to a wearer of the recreational shoe.

Figure 1:
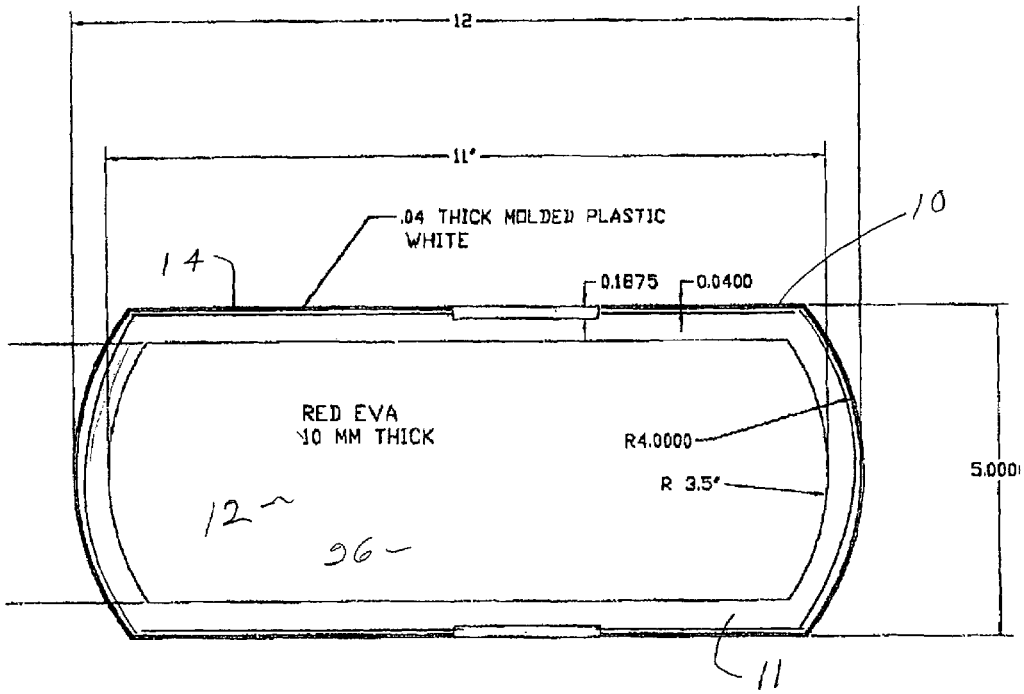
FIG. 1 is a top view of the carpet slide according to a presently preferred embodiment of the invention without the inclusion of the securing strap for securing the slide to a user's foot.
Figure 2:
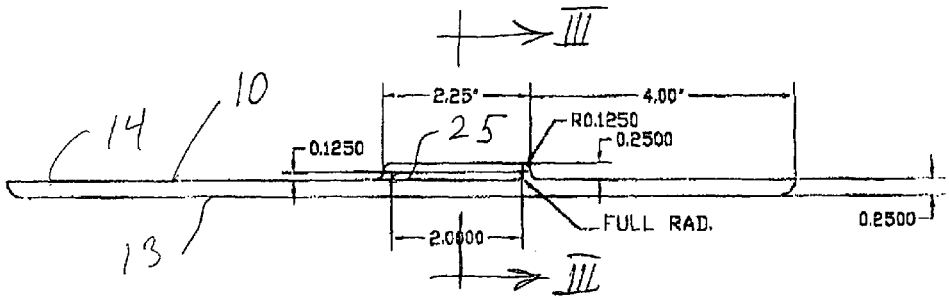
FIG. 2 is a side elevation view of the carpet slide shown in FIG. 1 without the saw tooth style gripping teeth.
Figure 3:
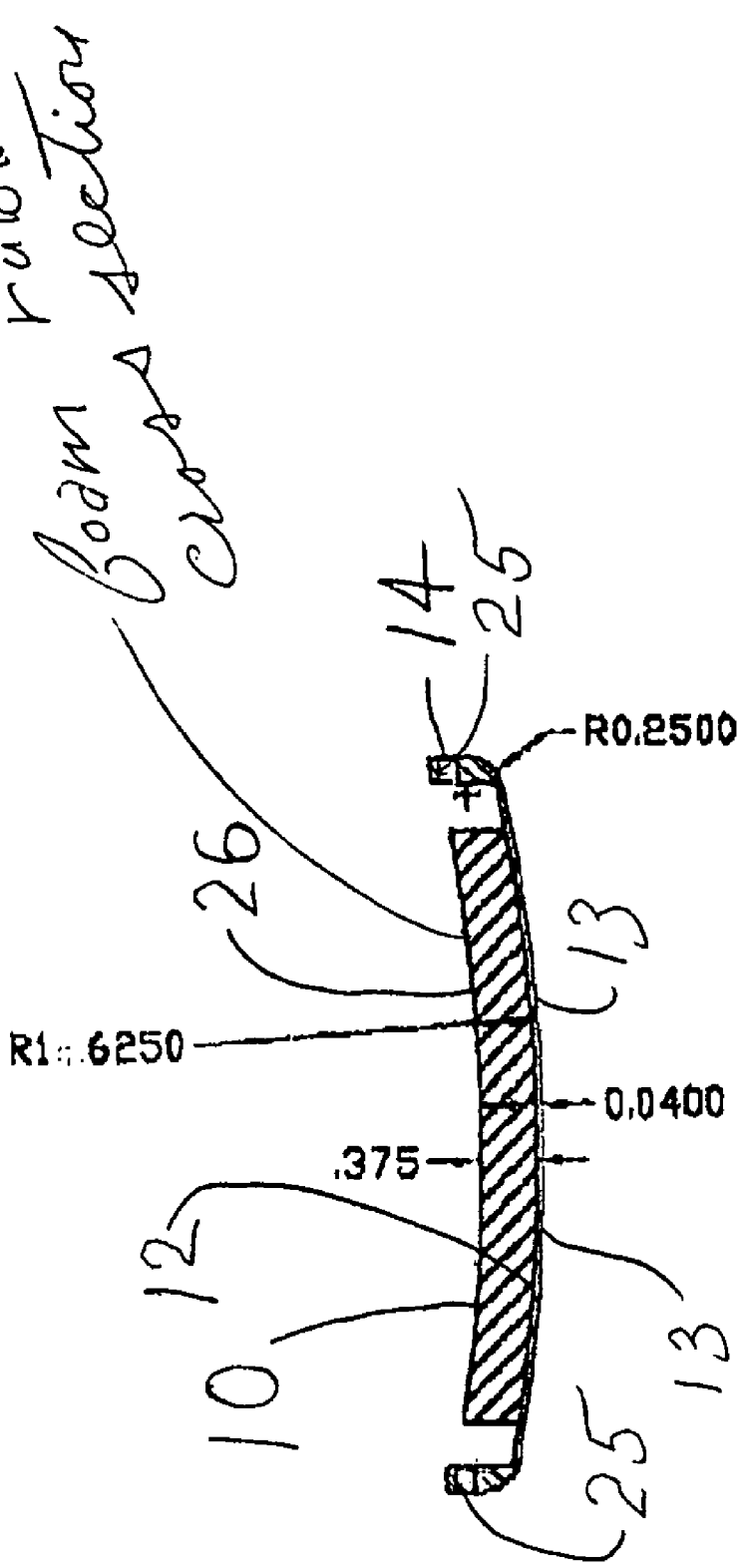
FIG. 3 is a cross sectional view of the carpet slide shown in FIGS. 1 and 2 as seen along section line III—III of FIG. 2.

BRIEF DESCRIPTION OF A PRESENTLY PREFERRED AND VARIOUS ALTERNATIVE EMBODIMENTS OF THE INSTANT INVENTION

Prior to proceeding to the more detailed description of the present invention it should be noted that identical components having identical functions have been identified with identical reference numerals throughout the several views illustrated in the drawings for the sake of clarity in understanding the invention.

Now refer more particularly to drawing FIGS. 1 through 7. Illustrated therein is a carpet slide, generally designated 10, manufactured according to the present invention. Such carpet slide 10 includes a first member 11 preferably formed from a flexible sheet of plastic material having an upper surface 12 and a bottom surface 13. In one of the presently preferred embodiments of the invention the first member 11 includes an upturned perimeter edge 14.

There is at least one strap like member which forms at least a portion of a means 15 for retaining such recreational shoe on a wearer's foot. Such at least one strap like member (not shown) includes a first end and a second end.

Figure 4:
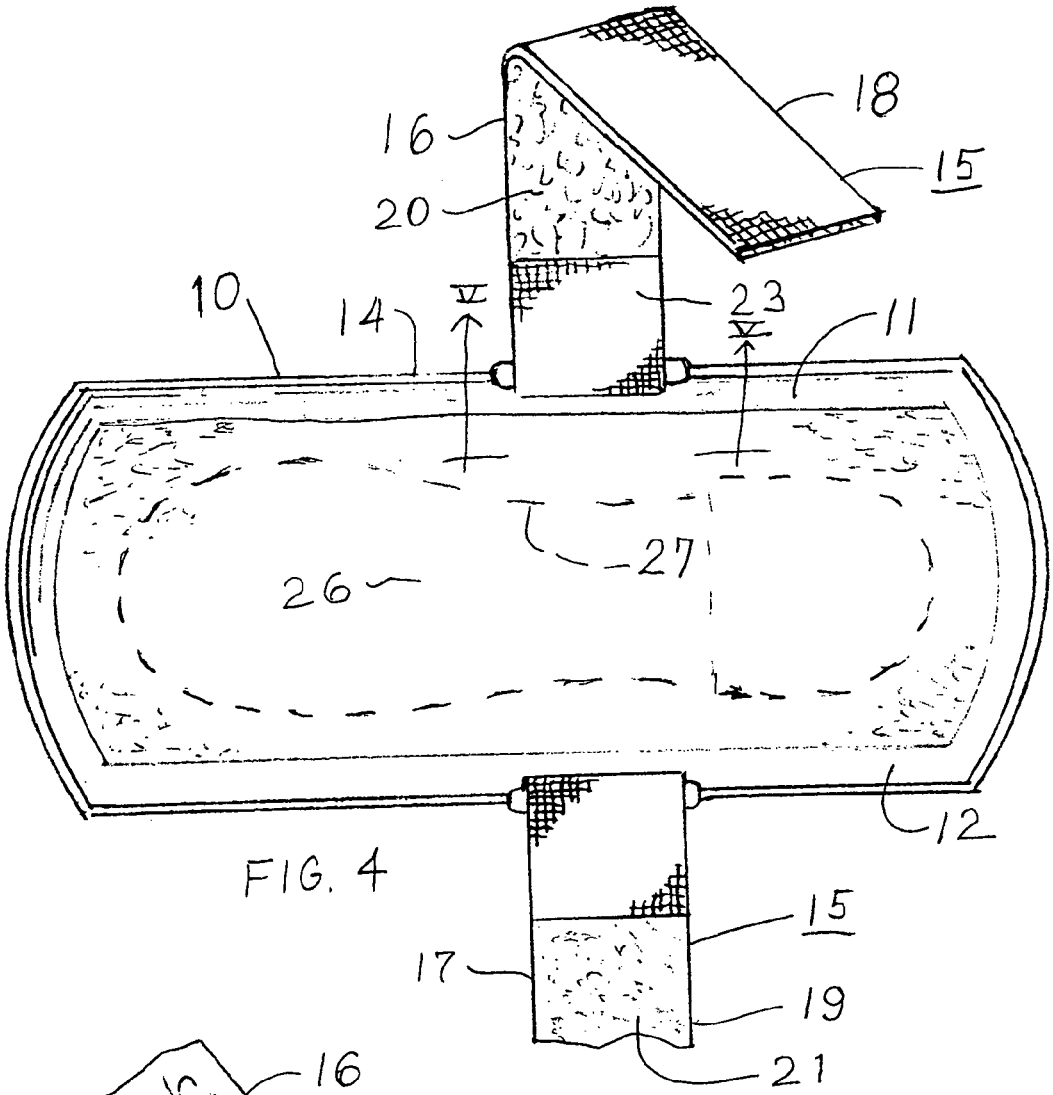
FIG. 4 is another top view of the apparatus of the carpet slide shown in FIG. 1 with the inclusion of the securement straps for securing the device to the user's foot.
Figure 5:
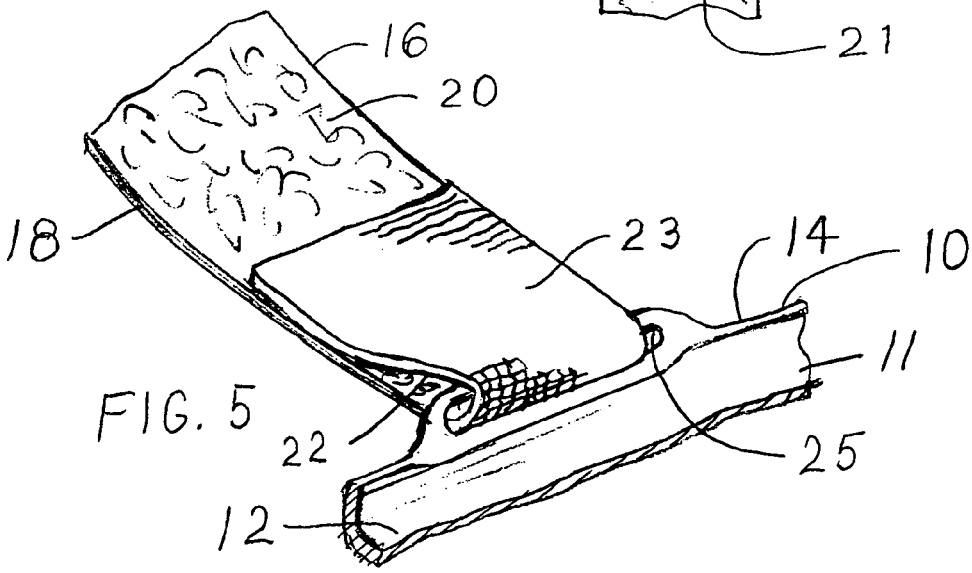
FIG. 5 is a perspective view in section as viewed along section V—V of FIG. 4 showing the detail of the attachment of the securement strap to the perimeter edge of the carpet slide.

As illustrated best in FIGS. 4 and 5, the means 15 is preferably in the form of a two piece strap having strap segments 16 and 17. In the presently preferred embodiment of the invention there is a hook and loop type material (VELCRO®) applied for securing the strap segments 16 and 17 to the perimeter edge 14 and also for securing the loose ends 18 and 19 of such strap segments 16 and 17 together. Strap 16 is provided with hook material 20 for securement to the loop surface 21 of strap 17.

In similar fashion, the under surface 22 of terminating end 23 of strap 16 may be provided with hoop material to engage loop material 20 after terminating end 23 of strap 16 has been passed through aperture 25 of upturn perimeter edge 14.

Figure 11:
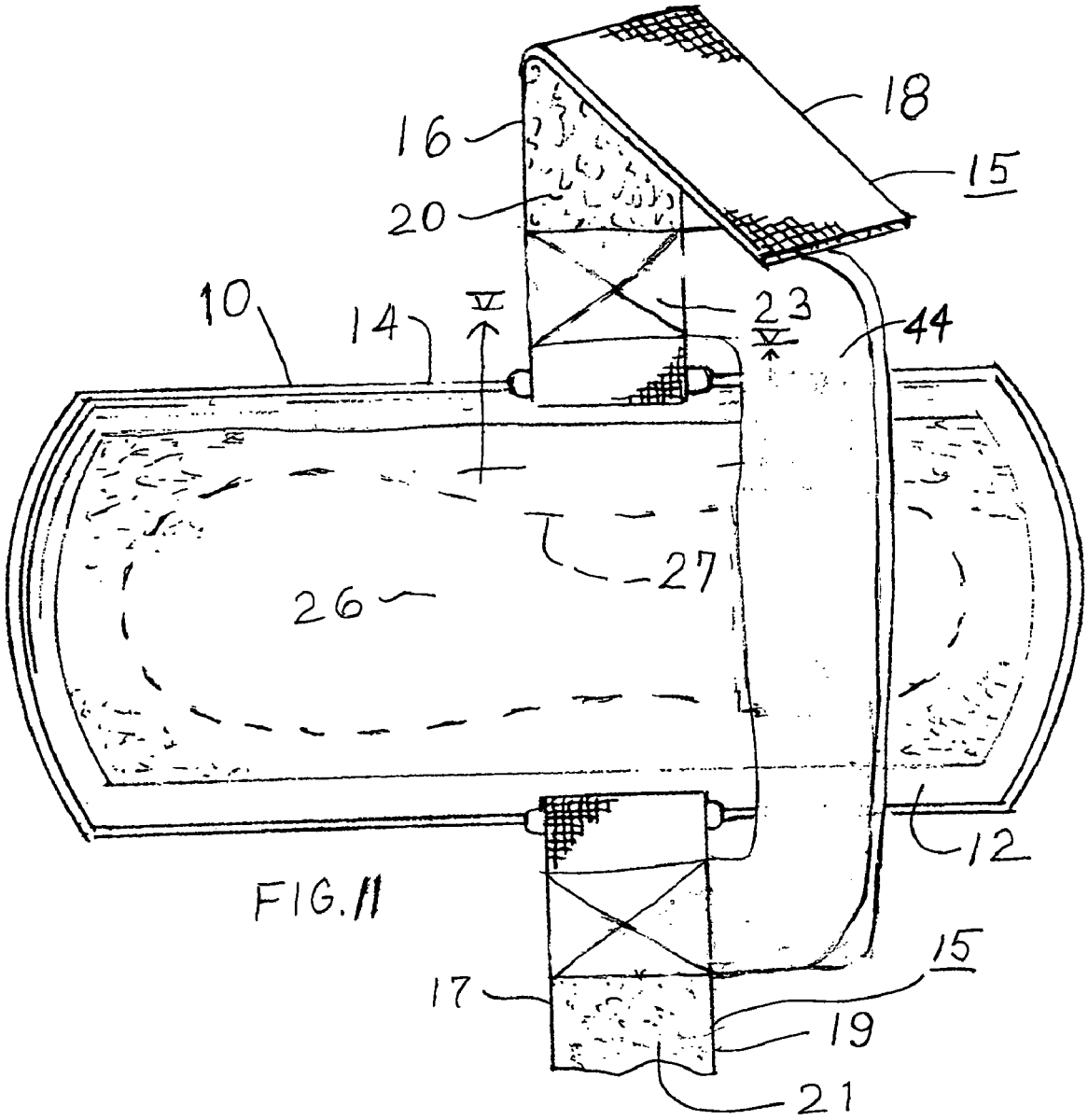
FIG. 11 is a plan view illustrating a strap member for engaging the user's heel attached to the pair of side straps.

Strap 17 connects to the perimeter edge 14 in the same fashion, except that the hook and loop surfaces may be reversed. Additionally, as shown in FIG. 11 there is a third strap like member 44 connected to strap like members 16 and 17 for abutting the heel of the user.

It is presently preferred that the bottom surface 13 of first member 11 is made to be convex in order to provide minimal surface contact with the carpet surface over which the carpet slide 10 is to be used. This provides minimal contact area and less friction and a more enjoyable sliding experience.

The upper surface 12 of the first member 11 is also provided, in the presently preferred embodiment, with a nonslip surface 26 which may be in the form of a foam pad to help prevent ones foot, as indicated by dashed outline 27, from slipping on the upper surface 12. Other non-skid surfaces may be substituted.

Figure 6:
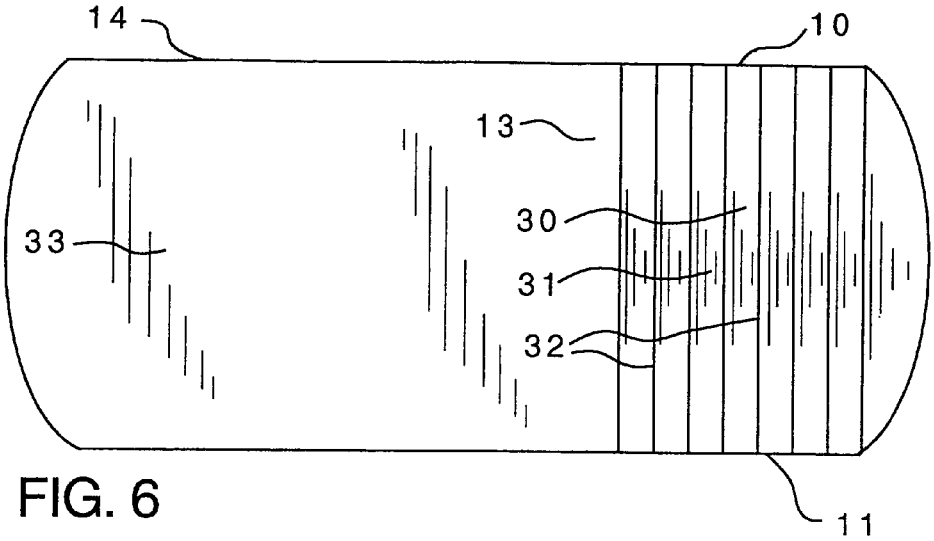
FIG. 6 is a bottom view of the carpet slide shown in FIG. 1 illustrating one embodiment of transverse saw tooth ribs on the forward toe portion of the slide for providing walking or running traction.
Figure 7:
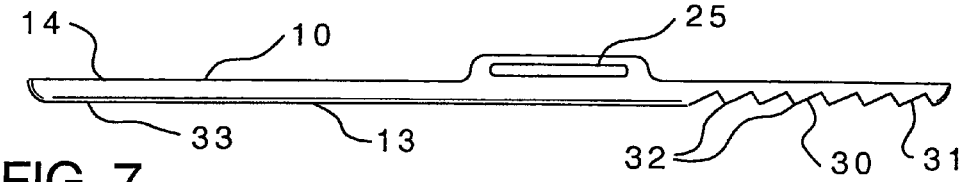
FIG. 7 is a side elevation view of the carpet slide shown in FIG. 6 engaging the carpet.
Figure 9:
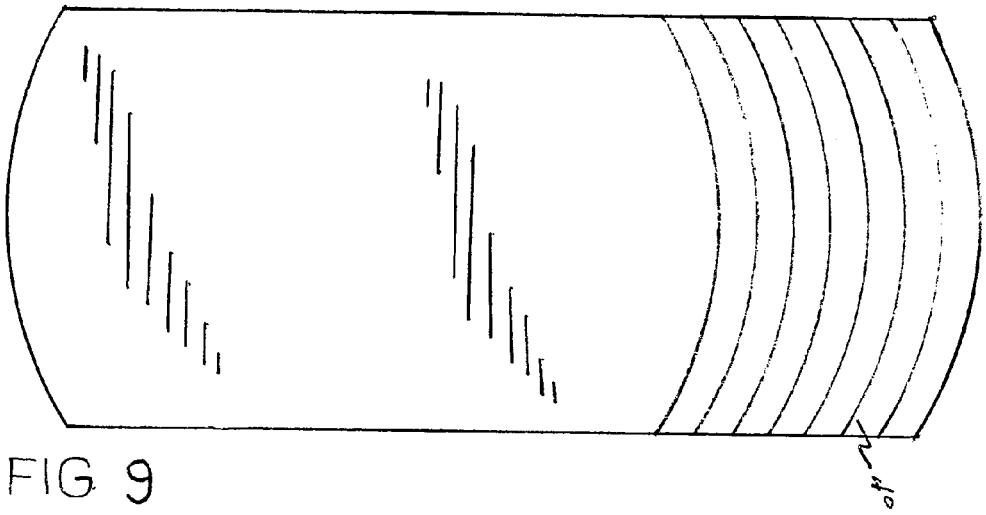
FIG. 9 is a bottom view of the carpet slide shown in FIG. 1 illustrating the presently preferred embodiment of arcuate saw tooth ribs on the forward toe portion of the slide for providing walking or running traction.
Figure 10:
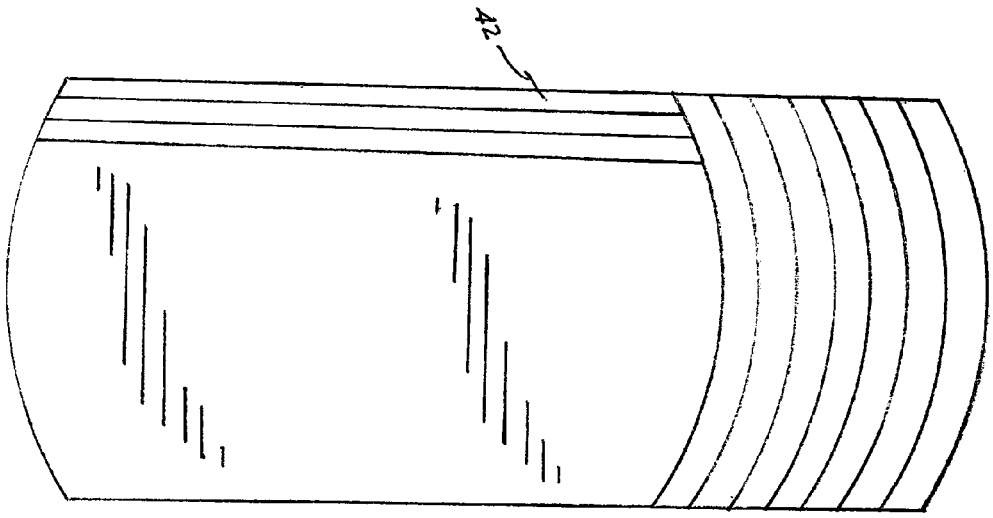
FIG. 10 is a bottom view of the carpet slide shown in FIG. 1 illustrating the presently preferred embodiment of arcuate saw tooth ribs disposed along an outer edge of the slide for enabling easier turning in a predetermined direction.

Referring next to FIGS. 6 and 7, a modification of the carpet slide shown in the previous figures is illustrated wherein the carpet slide 10 includes transverse sawtooth ribs 30 on the forward toe portion 31. These ribs 30 are of a sawtooth configuration having ridges 32 which face to or toward the rearward heel portion 33 of the bottom surface 13 of first member 11. As best seen in FIGS. 9 and 10, it is presently preferred that the saw tooth ribs 40 are arcuately shaped.

Thus, as the participant moves forward by walking or running when playing an athletic event, such as hockey, the sawtooth ribs 30 or 40 will dig into the carpet surface and provide enhanced traction. Yet by reason of the fact that the ridges 32 face rearward, this permits the participant to easily slide forward or to the side, when desired, on the carpeted surface.

Figure 8:
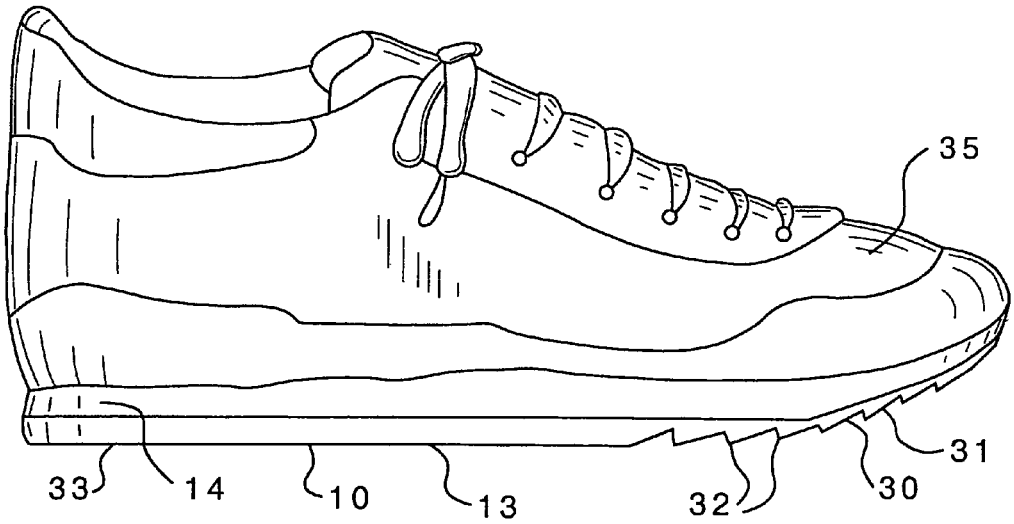
FIG. 8 is a perspective view illustrating the slide of FIGS. 6 and 7 integrally secured as a sole piece to an athletic shoe.

Referring next to FIG. 8, another modification of the present invention is illustrated wherein the means for securing the carpet slide 10 to ones foot is accomplished through the use of a conventional athletic shoe 35. The top face 13 of the slide itself is permanently glued directly to the sole of the shoe and provides a permanent sole for the shoe 35.

A presently preferable material for the carpet slide's first member 11 is a slippery flexible plastic, such as manufactured under the trademark Teflon.

Reference is now made, more particularly, to FIGS. 9 through 11 wherein there is illustrated the presently preferred embodiment of the invention. As seen therein in addition to the saw tooth ribs 40 being arcuately shaped there is provided at least one saw tooth ridge 42 formed on said bottom surface 13 substantially parallel to a length of said first member 11 and/or recreational shoe.

It can be seen, in summary, that the carpet slide 10 of the present invention is comprised of a sheet of material, preferably plastic, having top and bottom faces and an upturn perimeter edge to prevent catching of the edges on carpet surfaces. A mechanism is provided for easily securing a foot to the upper surface of each sheet.

In one embodiment, this means for securing the sheet or slide to the foot includes a two piece strap secured at opposite ends to the upturned perimeter edge of the sheet. This two piece Strap has an adjustable securing mechanism, such as a buckle, or more preferably a hook and loop fastener arrangement, for adjustably securing the two strap pieces together over ones foot for tight securement.

The top face is preferably provided with a non-slip surface.

The bottom face of the sheet is also preferably convex for more efficient and faster sliding contact with the carpet surface over which the participant intends to slide.

In another embodiment, the means provided for securing the carpet slide to one's foot may take on the form of a shoe, such as an athletic shoe, wherein the sole of the shoe itself is the sheet of material utilized as the carpet slide.

Also, in order to ensure good traction on an underlying carpet surface when the carpet slides are in use for playing such games as carpet hockey, transverse saw tooth ribs are provided on the forward toe portion of the bottom surface of the slide sheet for providing walking or running traction. These ribs have saw tooth ridges which face toward the rearward heel portion of the slide on the bottom surface of the slide for thereby providing a gripping action as the player moves forward, yet the saw tooth configuration permits the player to slide forward and sideways on the carpet. This gives the participant more control, particularly when playing a game such as hockey on a carpeted surface.

While a presently preferred and various alternative embodiments of the present invention have been described in detail above it should be understood that various other embodiments of the invention can be envisioned by those persons skilled in the art without departing from the spirit of the invention or the scope of the appended claims.

I claim:

1. A carpet slide for use as a recreational entertainment device, said carpet slide comprising:

(a) a first member having a predetermined shape and a predetermined size, said first member formed from a flexible sheet of material having an upper surface and a bottom surface;

(b) at least one strap like member, said at least one strap like member having a first end and a second end;

(c) a first means disposed along said upper surface of said first member adjacent a first outer edge portion thereof between a front portion of said first member and a back portion of said first member for engaging a first end of said at least one strap like member; and (d) a second means disposed along said upper surface adjacent a substantially radially opposed second outer edge portion thereof between said front portion of said first member and said back portion of said first member for engaging a second end of said at least one strap like member.

2. A carpet slide for use as a recreational entertainment device, according to claim 1, wherein said first means includes a first aperture formed therethrough for receiving said first end of said at least one strap like member through said first aperture and said second means includes a second aperture formed therethrough for receiving a second end of said at least one strap like member through said second aperture.

3. A carpet slide for use as a recreational entertainment device, according to claim 1, wherein said at least one strap like member serves as a securing means for enabling securing said carpet slide for recreational use to a user's feet.

4. A carpet slide for use as a recreational entertainment device, according to claim 2, wherein said at least one strap like member of said carpet slide for use as a recreational entertainment device includes a pair of strap like members, each of said pair of strap like members having a first end and a second end, a first end of a first one of said pair of strap like members secured to said carpet slide through said first aperture and a first end of a second one of said pair of strap like members secured to said carpet slide through said second aperture.

5. A carpet slide for use as a recreational entertainment device, according to claim 4, wherein said second end of each of said pair of said strap like members includes a respective portion of a securing means attached thereto for securing said carpet slide for recreational use to a user's feet.

6. A carpet slide for use as a recreational entertainment device, according to claim 5, wherein said carpet slide further includes a third strap like member having a first end secured to said first one of said pair of strap like members and a second end secured to said second one of said pair of strap like members, said third strap like member engaging a heel of such user.

7. A carpet slide for use as a recreational entertainment device, according to claim 5, wherein said securing means includes:

(a) one of a hook and loop member disposed adjacent said second end of said first strap like member; and (b) an opposite one of said hook and said loop member disposed adjacent said second end of said second strap like member for engaging said one of said hook and said loop member attached to said second end of said first strap like member.

8. A carpet slide for use as a recreational entertainment device, according to claim 5, wherein said securing means permits a length of said first and said second strap like member to be adjustable.

9. A carpet slide for use as a recreational entertainment device, according to claim 1, wherein said predetermined shape of said first member includes an upturned perimeter edge.

10. A carpet slide for use as a recreational entertainment device, according to claim 9, wherein said predetermined shape of said first member further includes said bottom surface being convex in a direction disposed transverse to a length of said first member.

11. A carpet slide for use as a recreational entertainment device, according to claim 1, wherein said carpet slide further includes a non slip surface material disposed on said upper surface of said first member.

12. A carpet slide for use as a recreational entertainment device, according to claim 1, wherein said first member is formed from plastic.

13. A carpet slide for use as a recreational entertainment device, according to claim 1, wherein said bottom surface of said first member closely adjacent said front portion thereof includes a predetermined plurality of saw tooth ridges formed therein for providing walking and running traction on a surface.

14. A carpet slide for use as a recreational entertainment device, according to claim 13, wherein said predetermined plurality of saw tooth ridges are formed facing toward a rearward heel portion of said bottom surface.

15. A carpet slide for use as a recreational entertainment device, according to claim 13, wherein said predetermined plurality of saw tooth ridges are arcuately shaped.

16. A recreational shoe for use in sliding on carpeted surfaces, said recreational shoe comprising:

(a) a foot supporting sole portion, having a predetermined shape and a predetermined size, said foot supporting sole portion formed from a sheet of flexible material having an upper surface and a bottom surface, said bottom surface of said foot supporting sole portion having a coefficient of friction which is at least low enough to enable easy sliding on such carpeted surface;

(b) a foot retaining upper portion secured to said top surface of said foot supporting sole portion; and (c) a securing means disposed on said foot retaining upper portion for securing said recreational shoe to a wearer of said recreational shoe.

17. A recreational shoe for use in sliding on carpeted surfaces, according to claim 16, wherein said securing means is one of a hook and loop type fastener, a zipper and laces.

18. A recreational shoe for use in sliding on carpeted surfaces, according to claim 16, wherein said predetermined shape of said sole portion of said recreational shoe includes said bottom surface being at least slightly convex in a direction disposed transverse to a length of said recreational shoe.

19. A recreational shoe for use in sliding on carpeted surfaces, according to claim 16, wherein said bottom surface of said foot supporting sole portion of said recreational shoe closely adjacent a front portion thereof includes a predetermined plurality of saw tooth ridges formed therein for providing walking and running traction on a surface.

20. A recreational. shoe for use in sliding on carpeted surfaces, according to claim 16, wherein said recreational shoe further includes at least one longitudinal ridge formed alone a length of said recreational shoe.

* * * * *